US005497812A

United States Patent [19]

Orosco et al.

[11] Patent Number: 5,497,812

[45] Date of Patent: Mar. 12, 1996

[54] APPARATUS FOR RAPIDLY FILLING A DRY WALL CEMENT DISPENSING TOOL

[76] Inventors: Anthony R. Orosco, 3320 N. Millbrook, Fresno, Calif. 93726; Alton P. Johnson, 40 Lewis St., Everett, Mass. 02149

[21] Appl. No.: 239,837

[22] Filed: May 9, 1994

Related U.S. Application Data

[63] Continuation-in-part of Ser. No. 925,874, Aug. 7, 1992, abandoned.

[51] Int. Cl.[6] ..... B65B 1/04

[52] U.S. Cl. ..... 141/21; 141/25; 141/18; 141/67; 417/403

[58] Field of Search ..... 141/21, 22, 23, 141/24, 25, 27, 18, 67; 417/552, 553, 403, 384, 545, 555.1, 556, 900, 487, 488, 489, 523, 534, 535, 56, 60, 264, 259, 262, 266, 267, 268, DIG. 2

[56] References Cited

U.S. PATENT DOCUMENTS

| | | | |
|---|---|---|---|
| 3,901,313 | 8/1975 | Doniguian et al. | 166/64 |
| 4,143,998 | 3/1979 | O'Connor | 417/413 |
| 4,634,197 | 1/1987 | Tornare et al. | 417/259 |

*Primary Examiner*—William A. Cuchlinski, Jr.
*Assistant Examiner*—David J. Walczak
*Attorney, Agent, or Firm*—John J. Murphey

[57] ABSTRACT

An apparatus for rapidly refilling a dry wall cement dispensing tool from a dry wall cement-filled bucket containing a thick-walled, heavy, metal pump tube for submerging into the dry wall cement contained therein, all of a weight to provide the pump tube with a low center of gravity when set in the bucket of dry wall cement, a cement-moving piston attached to the pump rod for reciprocal motion inside the pump tube, a thin-walled, light weight transfer device lighter in weight than the pump tube, extending outward from the aperture top end of the pump tube and in hydraulic communication therewith including a nozzle device for conveying the cement from the heavy pump tube into the cement dispensing tool, and a thin-walled, light weight pneumatic rectilinear reciprocating device lighter in weight than the pump tube, mounted above the tube of a size easily balanced by hand, interconnected the pump rod and including an actuation valve, for sequentially and rapidly raising and lowering the piston in the heavy pump tube to rapidly fill the dispensing tool, wherein the combination of the heavy pump tube, light weight transfer device and light weight reciprocating device provides a low center of gravity to the apparatus to allow it to be steadied in the bucket of cement.

7 Claims, 2 Drawing Sheets

APPARATUS FOR RAPIDLY FILLING A DRY WALL CEMENT DISPENSING TOOL

This application is a continuation-in-part of our previous application filed Aug. 7, 1992, carrying Ser. No. 07/925,874, and having the same title, that is now abandoned.

BACKGROUND OF THE INVENTION

1. Field of the Invention

This invention pertains to the construction industry. More particularly, it pertains to dry wall operations and to an apparatus for rapidly refilling dry wall cement dispensing tools.

2. Description of the Prior Art

Most everyone is familiar with dry wall construction. Dry wall comes in a sheet, generally four feet by eight feet in size and of a thickness ranging from one-half to seven-eights inches, having a sandwich construction with a gypsum center and heavy paper outer flat surfaces, cut to fit and placed against 2×4 wood or metal framing to form interior wall surfaces of most homes and offices. The sheets are butted together along their vertical and horizontal edges and nailed to the underlying frame. A two-inch wide elongated depression is formed along the peripheral edges to receive the nails that attach the sheets to the frame. It is mainly in this depression that dry wall cement and paper are later added to hide the nail heads and to which this invention is directed.

A dry wall finisher uses different tools to fill the depressions with one or more smooth thin layers of a water-base dry wall cement. Over the last or top layer is placed a thin paper tape so that the entire wall takes on a smooth, ripple-free surface that may be painted or overlaid with wall paper or other trimming. These tools are many and of varied sizes and shapes. Two of the most common are the nail spotter and the automatic taper.

The nail spotter comprises a magazine, called a "box-assembly" into which an inventory of dry wall cement is placed. A pair of spaced-apart wheels are located at the rear of the box and a flat blade is fixed at the front of the box next to a cement feed hole so that the box is supported for moving over the vertical dry wall surface. A handle extends from the box with which to manipulate the tool. A moveable cover is pivotally mounted over the open top of the box assembly and mechanically linked to apply pressure to the magazine full of cement to force a small amount to exude from the feed hole onto the wall. The nail spotter is used to fill hammer-made depressions and other dents formed in the dry wall during cutting, fitting and nailing it to the frame. The blade scrapes the cement over the depression to create the smooth finished surface.

The automatic taper is a more complex tool. It generally comprises an elongated hollow tube filled with an inventory of cement. At the front end of the tube is mounted a cross-axle for holding a roll of paper tape. Means are connected to the front end to unroll the tape in a controlled manner. A piston is slidably mounted inside the tube and presses against the inventory of dry wall cement from the rear end of the tube, forcing the cement toward the front and the tape. A cement issue aperture is set near the tape along with a blade or blades. The tool is pushed or pulled along the elongated depressions located about the peripheral edges of the dry wall to lay down a smooth thin layer of cement in the abutted depressions and overlay the cement with the finish dry wall paper to form a smooth, wrinkle-free surface.

There are dry wall finishing tools other than the two discussed herein, however, they all have one common trait, namely they hold an inventory of dry wall cement and this inventory becomes depleted during the dry wall finishing operation. Accordingly, these tools must be refilled with cement throughout the work day.

Dry wall cement is usually sold in five gallon buckets. The cement is wet and heavy, having the consistency of mortar but with a substantially finer particle size. Traditionally, the device used to reload a dry wall finishing tool is a hand-operated cement pump called a "stirrup pump" that is partially submerged in the open bucket of cement and supported therein by an elongated member attached to the top thereof that passes downward along the outside of the bucket, spaced-apart from the pump, to terminate in a flange upon which the operator places his foot when using the pump. A top-mounted pump handle is then manually moved up and down in a series of short strokes to slowly pump the cement from the bucket into the tool. In the case of the nail spotter, the box assembly is temporarily mated to the pump and the cement loaded in through the issue slot against the spring pressure to fill the magazine with an exudate of cement. In the case of the automatic taper, the issue hole is temporarily mated to the pump by a gooseneck that is attached to the pump, and the cement forced in through the issue aperture against the spring pressure. The pump handle is manipulated to slowly pump the cement into the tube.

While these dry wall finishing tools make for smooth finishing of installed dry wall, the overall process is time-consuming and very strenuous. The tools can be manipulated quite rapidly and the cement and paper quickly applied. However, the process of reloading the tools using the hand-operated stirrup pump is extremely slow and the pumping requirement is exhausting. Usually, the dry wall finisher becomes so worn out from pumping during the refill operation that the quickness and agility of using the tools are lost in the drudgery of the refill operation and the entire finishing process remains a slow, time-consuming operation with its attendant high labor costs.

SUMMARY OF THE INVENTION

This invention is an apparatus that significantly decreases the time and effort expended in the cement refill operation. It comprises a light weight pneumatic rectilinear piston pump attached to the piston of the stirrup cement pump, in place of the hand pump handle, of size and weight that keeps the overall mechanism bottom heavy so that it is easily balanced in the 5-gallon cement bucket. This device, with its low center of gravity, contains a manipulating valve to drive the cement pumping piston rapidly downward to load the pump and then rapidly upward to pump the cement into the tool. By controlling the movement or stroke of the pneumatic pump, the dry wall finisher can reload his tool within moments, such as 6–10 seconds, and return to his finishing duties free of the exhaustive efforts previously used in the hand-pump operation. Because the invention has such a low center of gravity, it is easily maintained in the cement bucket without extraneous support rods or pipes. Thus, it may be used in crowded areas in and about the construction site. The cement buckets are often situated in narrow passageways and this bottom-heavy invention may be used in these confined areas without taking up a lot of room. Use of this invention will lead to a significant improvement in dry wall finishing times, result in a better job, performed by fresh finishers, and at lower unit costs per structure.

Accordingly, the main object of this invention is an apparatus having a noticeable low center of gravity for use by a single dry wall finisher to reload his dry wall cement-containing tools with cement in a quick and efficient manner. Other objects include a means by which heavy dry wall cement may be expeditiously pumped from the traditional 5-gallon bucket or pail into the cement dispensing tool while avoiding the tiresome process of pumping the cement by hand; a means to free the dry wall finisher from the drudgery of handloading dry wall cement into his tools; an apparatus, having a low center of gravity, quickly moveable from one cement-filled bucket to another, for quickly refilling cement dispensing tools by one person; an apparatus that, because it is bottom-heavy, may be used in crowded areas in and about the construction site without extraneous supports; and, an apparatus for reducing the overall time for finishing dry wall construction so as to increase productivity and reduce unit costs.

These and other objects of the invention will become more apparent when reading the description of the preferred embodiment along with the drawings that are appended hereto. The protection sought by the inventor may be gleaned from a fair reading of the claims that conclude this specification.

DESCRIPTION OF THE PREFERRED EMBODIMENT

Figure 1:
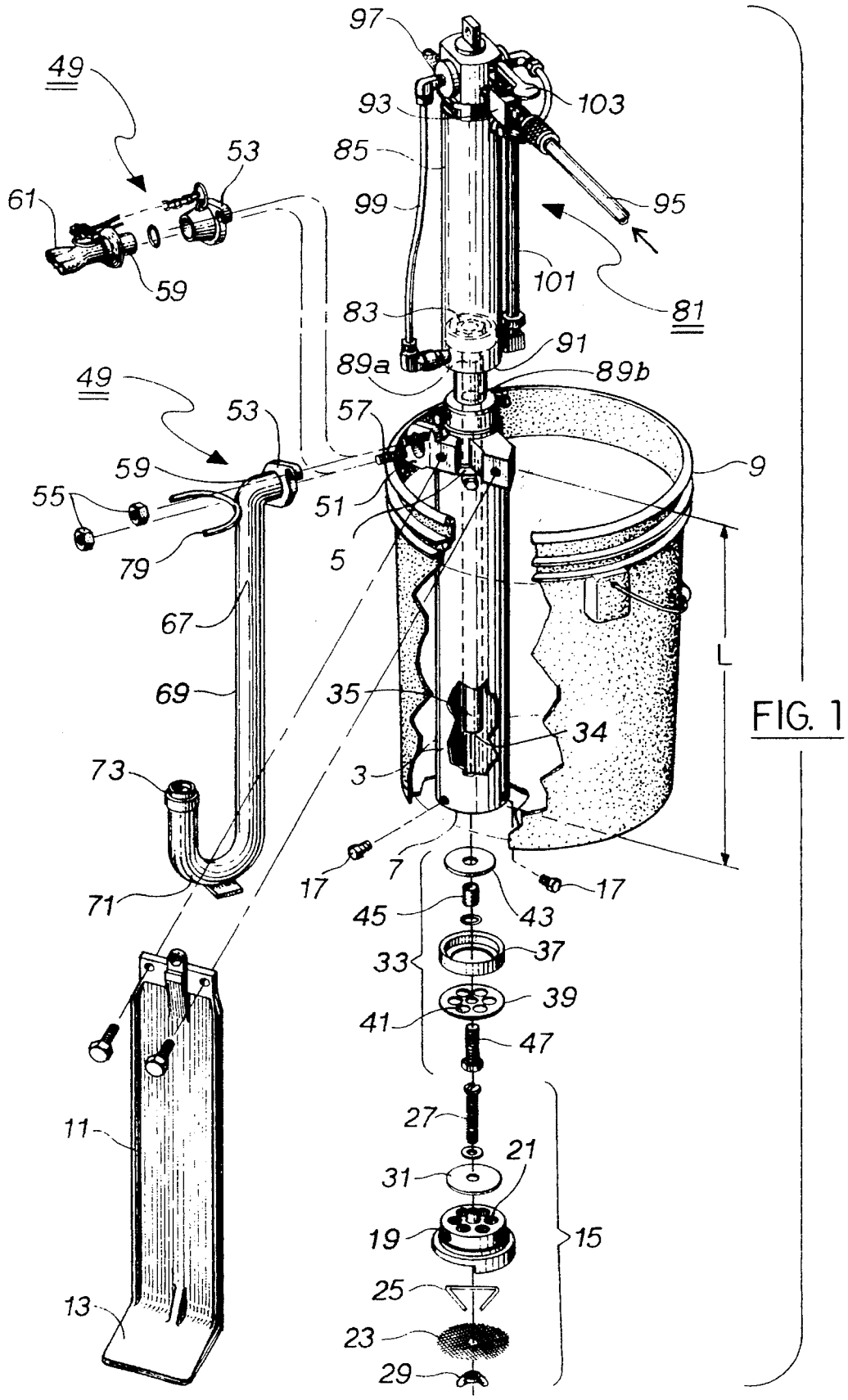
FIG. 1 is an illustrative view, partially in section and partially in exploded view, of the preferred embodiment of this invention situated in a common 5-gallon cement pail.

Turning now to the drawings wherein like elements are identified with like numerals throughout the three figures, the apparatus of this invention is identified by the number 1 and shown in FIG. 1 to comprise a thick-walled, metal, heavily weighted pump tube 3, made of steel or other strong material terminated by a closed top end 5 and an open bottom end 7. The length "L" of pump tube 3 is slightly greater than the inside depth of a 5-gallon pail 9 in which dry wall cement is commonly marketed and is supported by a heavy leg 11 extending from the top of tube 3 outward and downward, spaced-apart therefrom, along pail 9 to terminate in an outwardly extending flange 13 on which the operator places his foot (not shown) to steady pump tube 3 during manipulation of the invention. Tube 3 may be made longer to fit into larger vessels, however, the overall attributes of this invention are maximized where it is kept to length "L" as shown.

A foot valve 15 is attached to bottom tube end 7 by a series of screws 17 and comprises a valve body 19 having formed therethrough a plurality of vertical apertures 21 throughwhich the cement is pumped. A screen 23 is placed below said apertures and held in place by a screen support spring 25 and locked in place by a bolt 27 passing downward through the center of body 19 to a butterfly nut 29 that holds the parts together. A valve disc 31 rides on bolt 27 below the bolt head and above body 19 as shown in FIG. 1.

A pump piston 33 is centrally attached to the bottom end 34 of a pump rod 35 that is axially arranged inside pump tube 3 for reciprocal motion therein as will later be more fully explained. Pump piston 33 includes a piston wiper 37 that is centrally located above a piston plate 39 through-which a plurality of apertures 41 are formed. A piston disc 43 is slidingly mounted on a spacer sleeve 45 for reciprocal movement toward and away from piston wiper 37. A center bolt 47 is threadably received upward into bottom end 34 to retain the aforementioned elements in operable formation.

In operation, as pump rod 35 is raised in pump tube 3, piston disc 43 is forced down upon piston wiper 37 to close over apertures 41 and seal everything above said disc from leakage downward through pump piston 33. At the same time, the suction created in pump tube 3 by the raising of pump piston 33 (closed off by piston disc 43) raises valve disc 31 above apertures 21 to allow cement to be drawn upward through screen 23 and apertures 21 to fill pump tube 3. Screen 23 acts to prevent dried clumps of cement from entering tube 3. As pump rod 35 is on the downward stroke in pump tube 3, valve disc 31 is forced onto valve body 19 and closes over apertures 21, to seal the cement raised into tube 3 on the previous upward stroke, while piston disc 43 is forced upward to open apertures 41 and allow the cement to pass upward through apertures 41 above pump piston 33 to be forced further upward on the next upward stroke of pump rod 35. Therefore, with each upward movement of piston 33, cement will be forced out of pump tube 3 into a tool.

Figure 2:
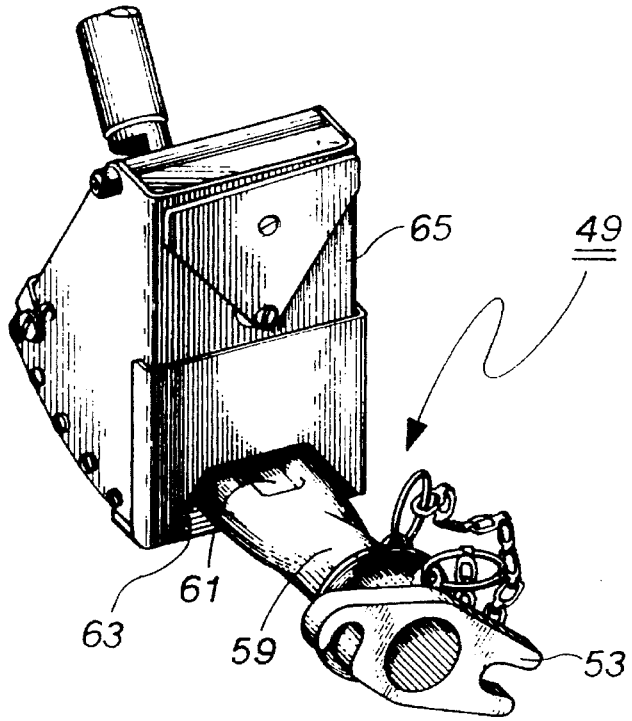
FIG. 2 is an illustrative view of the apparatus of FIG. 1 used to fill a nail spotter tool; and, FIG. 3 is another illustrative view of the embodiment of FIG. 1 used to fill an automatic tape tool.

Transfer means 49 is connected to pump tube 3 and extends outward from just below tube closed top end 5 through mating flanges 51 and 53 temporarily held together by nuts 55 and bolts 57 as shown and is in hydraulic communication therewith for conveying cement from bucket 9 to the tool. As shown in FIGS. 1 and 2, transfer means 49 includes a light weight nonflexible tube or duct 59 extending outward from top end 5 and a wide, flattened nozzle 61 attached thereto for forming the discharged cement into a ribbon-like exudate for conveniently and accurately passing the cement in through the issue slot 63 and into the magazine of a nail-spotter box assembly 65. The flat exudate allows more cement to be loaded in the magazine than would be possible with a round or rope-like exudate.

Figure 3:
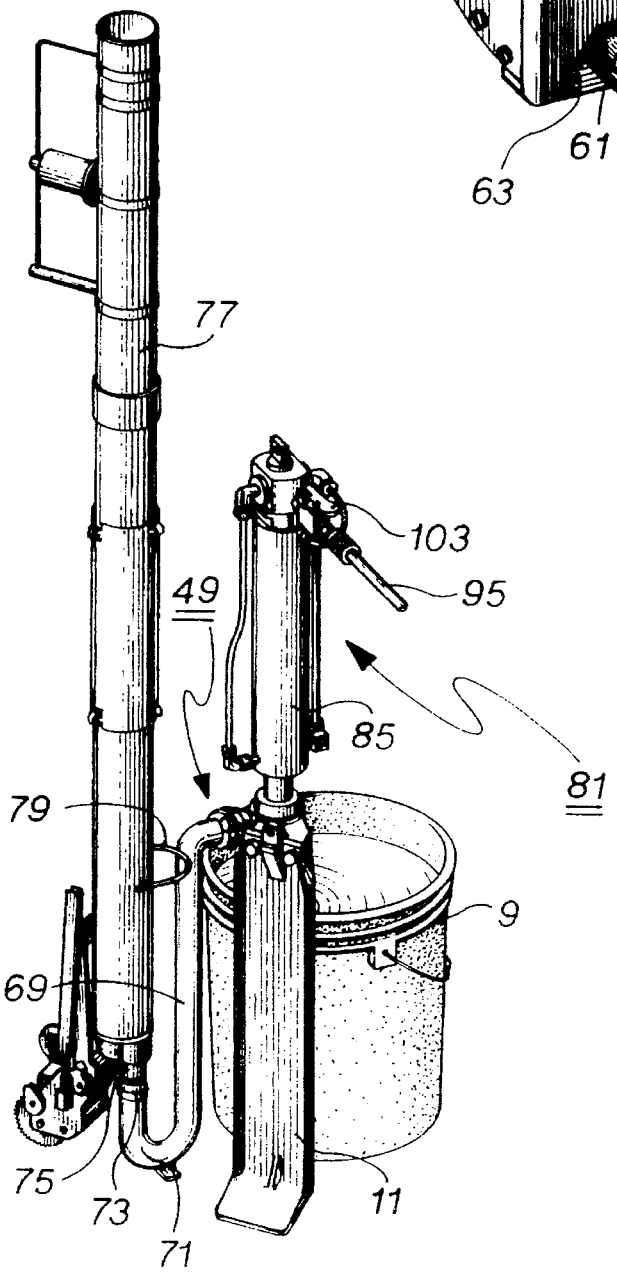

As shown in FIGS. 1 and 3, light weight transfer means 49 may also include a thin-walled, light weight nonflexible duct or J-shaped tube 67, generally referred to in the trade as a "gooseneck" that is connected to tube closed top end 5 and is in hydraulic communication therewith having an elongated portion 69 passing downward parallel to tube 3 and spaced apart therefrom and a U-shaped and upwardly directed portion 71 set spaced apart from pump tube open bottom end 7. An upwardly facing nozzle in the form of a round seat 73 terminates U-shaped portion 71 and is adapted for removable attachment to the cement issue aperture 75 of an automatic tape tool 77. A U-shaped bracket 79 is attached to elongated portion 69 to aid in holding tape tool 77 in place during the reloading cycle. The length of elongated portion 69 is such as to position the bottom of U-shaped portion 71 across from open tube bottom 7 so that tube 3 and gooseneck 67 may be conveniently held in a vertical position with cement pail 9 during the pumping operation.

Pneumatic means 81 is provided in the form of a very light weight air-driven piston 83 slidably positioned in an elongated light weight closed ended cylinder 85 for reciprocating movement therein, said cylinder preferably axially aligned and connected to the top of heavy pump tube 3 as shown in FIG. 1. Piston rod 35 extends from a piston 83 down through apertures 89a and 89b formed in bottom cylinder end 91, and pump tube closed top end 5 respectively, to pump piston 33 to interconnect them. A common air cylinder control valve 93 is provided on cylinder 85 and includes a compressed air inlet tube 95, a light weight vent tube 97 and air transfer lines 99 and 101 as shown. A light weight air transfer valve handle 103 is provided for manipulating drive piston 83 in reciprocating strokes in cylinder 85.

In operation, heavy pump tube 3 is submerged in pail 9 of cement and either flattened nozzle 61 or gooseneck 67 attached to top end 5. The device is steadied by the user's foot resting on flange 13 and further steadied by the low center of gravity built into the invention. The appropriate cement dispensing tool is placed next to the nozzle. While the operator steadies the bottom-heavy device vertically in pail 9, by the placement of his foot on flange 13, he manipulates air transfer valve handle 103.

During the upward stroke of air-driven piston 83, piston 33 rises in tube 3 drawing in an inventory of cement. During this upward stroke, valve disc 31 shuts off apertures 21. After reaching to top of its stroke, air-driven piston 83 is pushed downward by compressed air forcing it downward through the cement in tube 3. Pump piston apertures 41 open allowing cement to pass upward across piston 33. After reaching the bottom of pump tube 3 there is now an inventory of cement above piston 33. Upon the next upward stroke of piston 33, driven by air-driven piston 83, the inventory of cement above piston 33 is forced out through transfer means 49 into the tool magazine.

Simultaneously, a new inventory of cement is drawn up into pump tube 3 as piston apertures 41 are always closed during the upward stroke. The axial alignment of pneumatic means 81 and pump tube 3 and the closeness of transfer means 49 allows the invention to be used in crowded spaces and quickly moved from cement pail to cement pail to facilitate quick and efficient reloading. The low center of gravity of the apparatus plus the use of support leg 11 allows apparatus 1 to be steadied on the floor next to cement pail 9 to provide a loading area of small circumference and for use by operators of different height.

This invention has been shown to fill a nail spotter and a tape dispensing tool within 6 seconds as compared to the old hand pump method that required as long as 3 minutes and required so much muscle power as to exhaust the dry wall finisher. An important feature of this invention is the use of a heavy pump tube, located at the bottom of the pump, and a light-weight pneumatic drive means to create an apparatus having a low center of gravity. This low center of gravity is necessary to render the apparatus stable when placed in the pail of cement.

While this invention has been described with reference to a particular embodiment thereof, those skilled in the art will be able to make various modifications to the described embodiment of the invention without departing from the true spirit and scope thereof. It is intended that all combinations of elements and steps which perform substantially the same function in substantially the way to achieve substantially the same result are within the scope of this invention.

What is claimed is:

1. Apparatus for rapidly refilling a dry wall cement dispensing tool from a dry wall cement-filled bucket comprising:

a) a thick-walled, heavy metal pump tube having an open bottom end and an apertured top end of a length slightly exceeding the depth of the dry wall cement bucket for submerging into the dry wall cement contained therein;

b) a pump rod axially positioned inside said heavy pump tube and arranged for reciprocal movement therein;

c) a foot valve, located at said open bottom end of said pump tube, including a valve body having formed therethrough a first plurality of apertures through which the viscous cement is pumped, a screen located therebelow for preventing passage of lumps of cement, and a valve disk, of a size sufficient to close over said apertures, spaced above said valve body for movement against and away from said apertures, said foot valve, said valve body and said valve disk of a weight to provide said pump tube with a low center of gravity when set in the bucket of dry wall cement;

d) a cement-moving piston attached to said pump rod for reciprocal motion inside said pump tube and having formed therethrough a second plurality of apertures and a piston disk, slidingly mounted on a sleeve, above said apertures, for reciprocal movement against and away from said apertures for, on an upward stroke of said piston, simultaneously closing over said second apertures, to prevent passage of cement therethrough and to force cement above said piston in said tube out through said apertured top end of said pump tube, and raising from said first apertures for drawing in below said piston an inventory of new cement from the bucket, and on a downward stroke, simultaneously raising said piston disk from said second apertures, to allow passage of cement therethrough, and closing said valve disk against said first apertures to prevent passage of cement therethrough and passing said new cement from below said piston through said second apertures to a position above said piston;

e) thin-walled, light weight transfer means, lighter in weight than said pump tube, extending outward from said apertured top end of said pump tube and in hydraulic communication therewith including nozzle means for conveying the cement from said heavy pump tube into the cement dispensing tool; and, f) light weight pneumatic rectilinear reciprocating means, lighter in weight than said pump tube, mounted above said tube of a size easily balanced by hand, interconnected to said pump rod and including an actuation valve, for sequentially and rapidly raising and lowering said piston in said heavy pump tube to rapidly fill the dispensing tool;

g) wherein the combination of said heavy pump tube, light weight transfer means and light weight reciprocating means provides a low center of gravity to said apparatus to allow it to be steadied in said bucket of cement.

2. The apparatus of claim 1 wherein said light weight pneumatic rectilinear reciprocating means includes:

a) an elongated light weight cylinder, lighter in weight than said pump tube, arranged above said heavy pump tube and interconnected therewith of an overall length such that said cylinder and said pump tube can easily be balanced vertically over said heavy pump tube in a pail of dry wall cement; and, b) a compressed air-driven piston reciprocally mounted in said cylinder and connected to said pump rod;

c) wherein movement of said actuation valve causes said air-driven piston to move up and down in said cylinder to drive said cement-moving piston through an upward and downward cement-moving stroke.

3. The apparatus of claim 1 wherein said light weight reciprocating means and said thick-walled, heavy metal pump tube are arranged in axial alignment.

4. The apparatus of claim 1 further including a heavy leg extending outward from said pump tube and downward therealong and spaced-apart therefrom to terminate in an outwardly extending flange for stepping upon by the operator to cooperate with said heavy pump tube and steady said apparatus vertically in said bucket of cement.

5. Apparatus for rapidly refilling a dry wall cement dispensing tool from a dry wall cement-filled bucket comprising:

a) a thick-walled, heavy metal pump tube having an open bottom end and a closed top end and of a length slightly exceeding the depth of the dry wall cement bucket for submerging into the dry wall cement contained therein;

b) a heavy metal pump rod of terminal length axially positioned inside said heavy pump tube and arranged for reciprocal movement therein;

c) a foot valve, located at said open end of said pump tube, including a valve body having formed therethrough a first plurality of apertures through which the viscous cement is pumped, a screen located therebelow for preventing passage of lumps of cement, and a valve disk, of a size sufficient to close over said apertures, spaced above said valve body for movement against and away from said apertures;

d) a cement-moving piston attached to said heavy pump rod for reciprocal motion inside said heavy pump tube and having formed therethrough a second plurality of apertures and a piston disk, slidingly mounted on a sleeve, for reciprocal movement against and away from said apertures for, on an upward stroke of said piston, simultaneously closing over said second apertures, to prevent passage of cement therethrough, and raising from said first apertures to force cement above said piston in said tube out through said apertured top end of said pump tube and draw in below said piston an inventory of new cement from the bucket, and on a downward stroke, simultaneously raising from said second apertures and closing against said first apertures to prevent passage of cement therethrough and passing said new cement from below said piston through said second apertures to above said piston;

e) light weight pneumatic rectilinear reciprocating means, lighter in weight than said pump tube, mounted above said tube of a size and weight easily balanced by hand and interconnected to said pump rod and including an actuation valve, for sequentially rapidly raising and lowering said piston in said pump tube to rapidly fill the dispensing tool with dry wall cement;

f) wherein said pneumatic reciprocating means includes:

i) a elongated light weight cylinder arranged above said pump tube and interconnected therewith;

ii) a compressed air-driven piston reciprocally mounted in said cylinder of an overall length and weight such that said cylinder and said pump tube can be balanced vertically on a pail of dry wall cement; and, iii) a rod interconnecting said air-driven piston and said pump rod;

iv) wherein movement of said actuation valve causes said air-driven piston to move in said cylinder to power said cement-moving piston through an upward and downward cement-moving stroke;

g) wherein the combination of said heavy pump tube, light weight transfer means and light weight reciprocating means provides a low center of gravity to said apparatus to allow it to be steadied in said bucket of cement.

6. The apparatus of claim 5 wherein said light weight cylinder and said heavy pump tube are arranged in axial alignment.

7. The apparatus of claim 5 further including a heavy leg extending outward from said heavy pump tube and downward therealong and spaced-apart therefrom to terminate in an outwardly extending flange for stepping upon by the operator to steady said apparatus vertically in said cement-filled bucket.

* * * * *